United States Patent [19]

Butts et al.

[11] Patent Number: 5,065,997

[45] Date of Patent: Nov. 19, 1991

[54] SHEET INVERTER AND STACKING APPARATUS

[75] Inventors: Richard E. Butts; John C. Davis, both of Rochester, N.Y.

[73] Assignee: Xerox Corporation, Stamford, Conn.

[21] Appl. No.: 484,962

[22] Filed: Feb. 26, 1990

[51] Int. Cl.[5] ..... B65H 29/00

[52] U.S. Cl. ..... 271/187; 271/315; 271/82; 355/290

[58] Field of Search ..... 271/187, 314, 315, 82, 271/277; 355/290

[56] References Cited

U.S. PATENT DOCUMENTS

| | | | |
|---|---|---|---|
| 4,149,797 | 4/1979 | Imperial | 355/290 |
| 4,385,756 | 5/1983 | Beery . | |
| 4,431,177 | 2/1984 | Beery et al. . | |
| 4,901,996 | 2/1990 | Schlough | 271/187 |

FOREIGN PATENT DOCUMENTS

| | | | |
|---|---|---|---|
| 2168686 | 6/1986 | United Kingdom | 271/315 |

*Primary Examiner*—H. Grant Skaggs
*Assistant Examiner*—Carol Lynn Druzbick

[57] ABSTRACT

A sheet inverter and stacking apparatus has at least one sheet inverter wheel having at least one arcuate sheet retaining slot into which a sheet may be inserted. The wheel is incrementally rotated from a sheet load position to a sheet unload position and a sheet is driven in the process direction into the slot when the inverter wheel is in the load position. The sheet is removed from the slot, stacked in a stacking tray and its leading edge registered. The sheet retaining slot provides minimal resistance to sheet movement in the slot upon insertion in the slot in the process direction and provides high resistance to sheet movement in the slot in a sideways direction transverse to the process direction.

21 Claims, 8 Drawing Sheets

SHEET INVERTER AND STACKING APPARATUS

BACKGROUND OF THE INVENTION

The invention relates to sheet inverter and stacking apparatus and in particular to the offsetting and accurate registration of sheets produced from automatic printing machines at high speeds.

In an electrostaticgraphic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas on the photoconductive insulating area to form a powder image on the photoconductive areas. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle. Alternatively, the electrostatic latent image may be generated from information electronically stored or generated in digital form which afterwards may be converted to alphanumeric images by image generation, electronics and optics. In such a printer application a beam of light such as a laser beam may be used to selectively discharge the photoconductor.

Commercial applications of this process have taken various forms. One in particular is that of the printer application referred to above wherein finished sets of prints are collected such that the registered edge of successive sets are offset slightly each from the other.

PRIOR ART

U.S. Pat. No. 4,385,756 to Beery describes a sheet inverting and stacking apparatus which includes a rotatable inverter wheel having at least one arcuate sheet retaining slot into which a sheet maybe inserted. The slot is sufficiently large in length that a substantial portion of the sheet maybe inserted in the slot without the leading edge of the sheet contacting the end of the slot. It has a driver to incrementally rotate the wheel from the sheet load position to a sheet unload position, and a driver to drive a sheet into the slot at the load position. The distance between the sheet driver and the end of the slot in the wheel is greater than the length of a sheet to be fed. A sheet stripper registration member is provided at the unload position to strip a sheet from within the slot and register its leading edge. In a specific embodiment the inverter comprises a fixed member having a generally cylindrical surface from the load position to the unload position and two parallel arcuate arms of large diameter having parallel slots therein for transporting sheets from the load to the unload position, and wherein the parallel arms are brought to a stop at both the load and unload position.

U.S. Pat. No. 4,431,177 to Beery et, al, in addition to describing the same sheet inverting and stacking apparatus as in U.S. Pat. No. 4,385,756 describes a sheet offsetting and registration apparatus having an offset registration member positioned along an edge of the sheet transport path which is movable laterally with a directional component perpendicular to the direction of sheet transport to gently tap the edge of the sheet and offset and register it during its path of travel.

The devices described in the above referenced U.S. Patents have found commercial implementation in the Xerox 2700 Printer and the Xerox 3700 Printer which produce prints at the rate of twelve prints per minute and twenty-four prints per minute respectively. While capable of performing the function difficulties maybe encountered with the described devices when the printing rate is increased substantially. In particular, it has been found with increased printing speed that the inversion process inherently introduces an undesirable variation in the placement of each sheet in the cross machine direction. Furthermore, the offset registration member can further contribute to this sheet scatter in that as a result of increasing the printers speed the offset registration member must also move at an increased speed. As a result during the side shifting motion of the offset registration member the sheet is pushed by the member, and upon the offset registration member coming to a stop at the end of its push stroke the sheet does not necessarily come to a stop since its motion is inhibited only by the side shift resistance caused by the frictional contact between the sheet and the surfaces of the slot. As the offset registration members operating speed is increased, it has been found that when the offset registration member comes to a stop the sheet does not but rather continues to travel in a cross machine direction creating scatter or misplacement sheet to sheet in any particular job set. The scatter produced between sheets in a given set and the scatter produced between sets substantially reduces customer acceptability and convenience.

SUMMARY OF INVENTION

It is accordingly a principle objective of the present invention, to provide a sheet inverter and stacker capable of operation at high speed without producing undesirable scatter between sheets in a given set or producing undesirable scatter between different sets.

In accordance with a principle aspect of the present invention, a sheet inverter and stacking apparatus is provided comprising at least one sheet inverter wheel having at least one arcuate sheet retaining slot into which a sheet maybe inserted, means to incrementally rotate the wheel from a sheet load position to a sheet unload position, drive means to drive a sheet in the process direction into the slot when the inverter wheel is in the load position, means to remove the sheet from the slot, stack it in a stacking tray and register its lead edge, and wherein the retaining slot includes means to provide minimal resistance to sheet movement in the slot upon insertion in the process direction and to provide high resistance to sheet movement in the slot in a sideways direction transverse to the process direction.

In a further aspect of the present invention the resistance means includes a sheet guide member on the entrance to the arcuate sheet retaining slot and a roller assembly in the entrance to the arcuate sheet retaining slot and being in opposed relationship to the guide member which has a portion forming an interference in the nominal tangential sheet path with the roller thereby providing a high resistance to sheet movement in the slot in a sideways direction transverse to the process direction.

In a further aspect of the present invention the interference in the nominal tangential sheet path is less than about 1.0 millimeters.

In a further aspect of the present invention the roller assembly comprises a roller support for freely rotatably supporting the roller in the process direction the support being pivotally mounted on the wheel and having an adjustable element for positioning the roller in the slot entrance and including means to spring bias the positioning element into position against the stop member.

In a further aspect of the present invention the roller has a hardness of from about 40 to 50 Shore A.

In a further aspect of the present invention the roller assembly is removably and replaceably mounted on the wheel.

In a further aspect of the present invention an offset registration member, is positioned along an edge of the sheet transport adjacent the unload position which is movable laterally with a directional component transverse to the direction of the sheet transport and includes means to laterally move the offset registration member with a directional component transverse to the direction of sheet transport as the sheet is transported passed the member whereby the side edge of the sheet is gently tapped, offset and registered during its path of travel.

In a further aspect of the present invention the distance between sheet drive means and end of the inverter wheel when in the load position is greater than the length of a sheet to be fed whereby the leading edge of the sheet does not contact the end of the slot.

For better understanding as well as other objects and further features thereof reference is had to the following drawings and description.

DESCRIPTION OF PREFERRED EMBODIMENT

Figure 1:
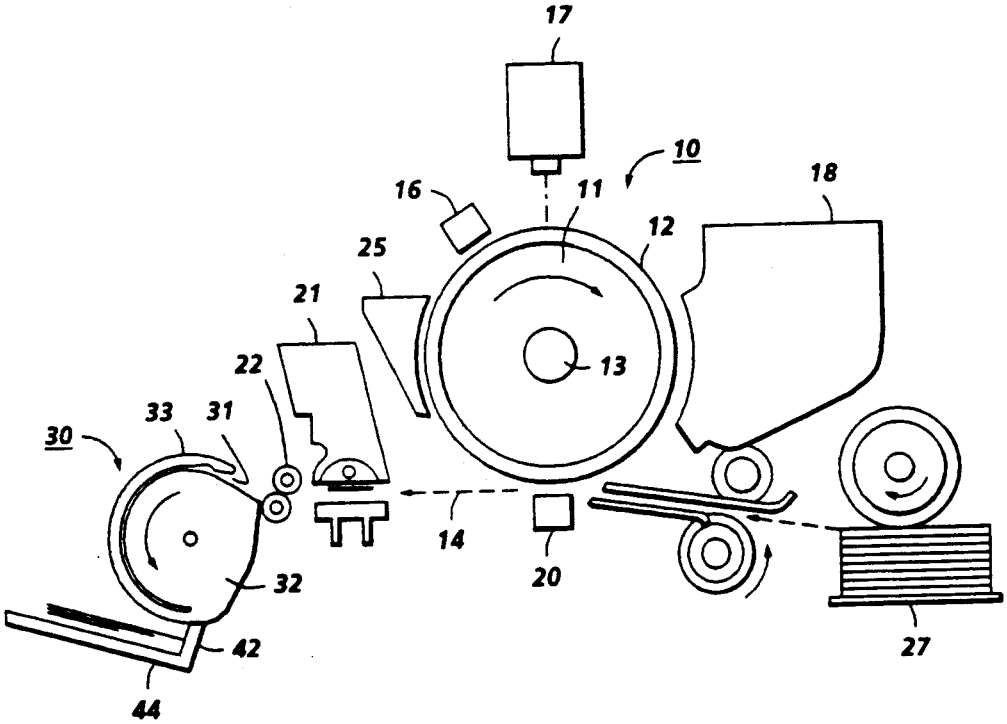
FIG. 1 is a schematic representation in cross section of an automatic electrostatographic printing apparatus employing the sheet inverter and stacking apparatus of the present invention.

Referring now to FIG. 1, there is shown by way of example an automatic xerographic reproducing machine 10 which incorporates the sheet inverter and stacker of the present invention. The reproducing machine 10 depicted in FIG. 1 illustrates the various components utilized therein for producing copies from an original. Although the sheet inverter and stacker of the present invention is particularly well adapted for use in an automatic xerographic reproducing machine 10, it should become evident from the following description that it is equally well suited for use in a wide variety of machines where it is desired to invert and stack processed sheets. It is not necessarily limited in its application to the particular embodiment shown herein.

The reproducing machine 10 illustrated in FIG. 1 employs an image recording drum-like member 11 the outer periphery of which is coated with a suitable photoconductive material 12. The drum 11 is suitably journaled for rotation within a machine frame (not shown) by means of a shaft 13 and rotates in the direction indicated by the arrow to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet 14 of final support material. Initially, the drum 11 moves photoconductive surface 12 through charging station 16 where an electrostatic charge is placed uniformly over the photoconductive surface 12 of the drum 11 preparatory to imaging. The charging may be provided by a corona generating device.

Thereafter, the drum 11 is rotated to exposure station 17 where the charged photoconductive surface 12 is exposed to a light image of the original input scene information, whereby the charge is selectively dissipated in the light exposed regions to record the original input scene in the form of a latent electrostatic image.

The optical system may be a conventional scanning or stationary optics or may be an electronically controlled and actuated laser source which successively strikes the photoconductive surface as a raster scan.

After exposure, drum 11 rotates the electrostatic latent image recorded on the photoconductive surface 12 to development station 18 where a conventional developer mix is applied to the photoconductive surface 12 rendering the latent image visible. Typically a magnetic brush development system utilizing a magnetizable developer mix having carrier granules and a toner colorant is used. The developer mix is continuously brought through a directional flux field to form a brush thereof. The electrostatic latent image recorded on photoconductive surface 12 is developed by bringing the brush of developer mix into contact therewith.

The developed image on the photoconductive surface 12 is then brought into contact with a sheet 14 of final support material within a transfer station 20 and the toner image is transferred from the photoconductive surface 12 to the contacting side of the final support sheet 14. The final support material may be paper, plastic, etc., as desired. After the toner image has been transferred to the sheet of final support material 14, the sheet with the image thereon is advanced to a suitable radiant fuser 21, which coalesces the transferred powdered toner image thereto. After the fusing process, the sheet 14 is advanced by fuser output rolls 22 to the inverter and stacker 30 of the present invention.

Although a preponderance of toner powder is transferred to the final support material 14, invariably some residual toner remains on the photoconductive surface 12 after the transfer of the toner powder image to the final support material 14. The residual toner particles remaining on the photoconductive surface 12 after the transfer operation are removed as the surface moves through cleaning station 25. Here the residual toner particles are first brought under the influence of a cleaning corona generating device (not shown) adapted to neutralize the electrostatic charge remaining on the toner particles. The neutralized toner particles are then mechanically cleaned from the photoconductive surface 12 by conventional means as, for example, the use of a resiliently based knife blade.

If desired the sheets 14 of final support material processed in the automatic xerographic reproducing machine 10 can be stored in the machine within a removable paper cassette 27.

Figure 2:
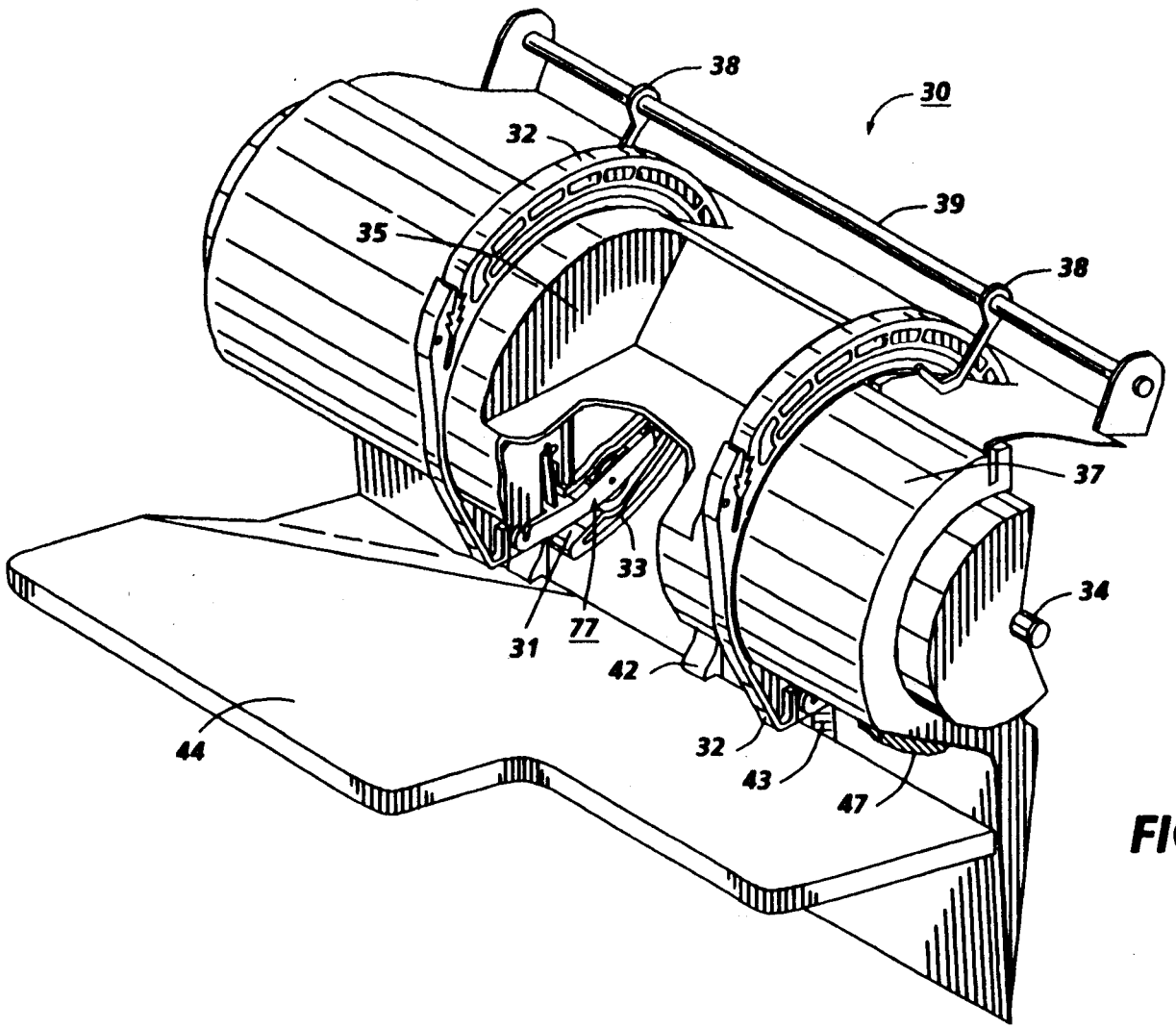
FIG. 2 is an isometric view from the right front of the sheet inverter and stacker of the present invention.

With continued reference to FIG. 1 and additional reference to FIG. 2 the inverter stacker 30 is placed at the output station of the fuser output rolls 22 such that the rolls drive a sheet to be inverted into the slot 31. When the sheet has left the output fuser rolls and is inside the slot 31 the inverter wheel 32 is rotated counterclockwise about 180° and the stripping registration members 42 strip the sheet from the slot 31 in the wheel 32 finally depositing the sheet in tray 44 as the wheel continues to turn.

The inverter stacker 30 comprises an interior stationary drum or hub 37 which is generally circular in configuration from the inverter wheel load position to the unload position and rounded from the sheet unload to load position. The drum 37 has a hand indent 35 in the center to facilitate manual sheet removal should the need arise if jamming of a sheet occurs. A drive shaft 34 which is driven by means not shown drives two or three parallel arcuate arms 33 having parallel arcuate sheet retaining slots from the sheet load to the sheet unload position. Sheet guides 38 mounted on shaft 39 assist in guiding a sheet into the retaining slots 31, which are coefficiently long in arcuate length to accommodate at least a substantial portion of the length of a sheet without the leading edge of the sheet contacting the slot's end. Furthermore, the distance between the sheet drive means and the end of the slot when in the load position is greater than the length of a sheet to be fed so that the lead edge of the sheet does not contact the end of the slot. After insertion of the sheet as the wheels are turned and the sheet moves from the load to the unload position, the trailing portion is maintained in position against the hub 37 by sheet guides 38. When the parallel arms turn counterclockwise the sheet is retained within the slots 31. However as the arms turn through the bottom portion of the arc they pass through apertures 43 in the stationary hub 37. When the lead edge of the sheet in the slot 31 approaches the unloading position the vertical stripping registration members 42 which are interposed between and on the outsides of the arms 33 strip the sheet from the slot into the sheet collecting tray 44. As the sheet is stripped from slot 31 registration of the leading edge of the sheet is achieved as the sheets abut against the members 42. Registration is also maintained as the arm rotates completely out of position, each sheet having its leading edge registered in the tray. This is readily facilitated because as each sheet is stripped from slot 31 it drops into the tray free of friction between adjacent sheets because the velocity of the sheet being stripped is zero relative to the previous sheet in the tray.

Referring to FIG. 2 the offset tapper head 47 maybe seen on the surface of the stationary hub or drum 37 near the bottom to provide an offsetting action to the sheet. The offset registration member is positioned along an edge of the sheet transport adjacent the unload position and is movable laterally with a directional component transverse to the direction of the sheet transport to gently tap, offset and register a sheet during its path of travel.

Figure 3:
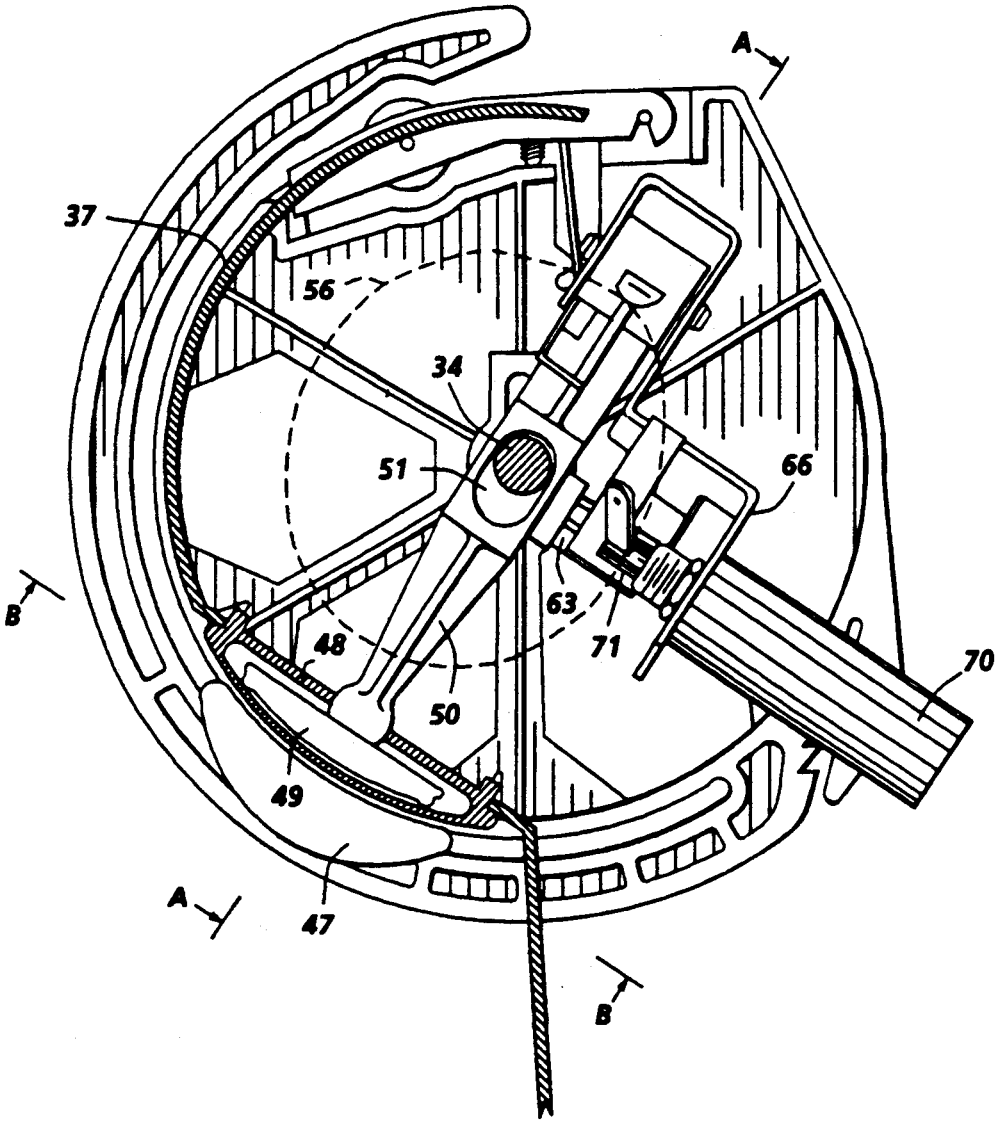
FIG. 3 is an end view of the inverter stacker showing the offsetting mechanism with the latch engaged.
Figure 4:
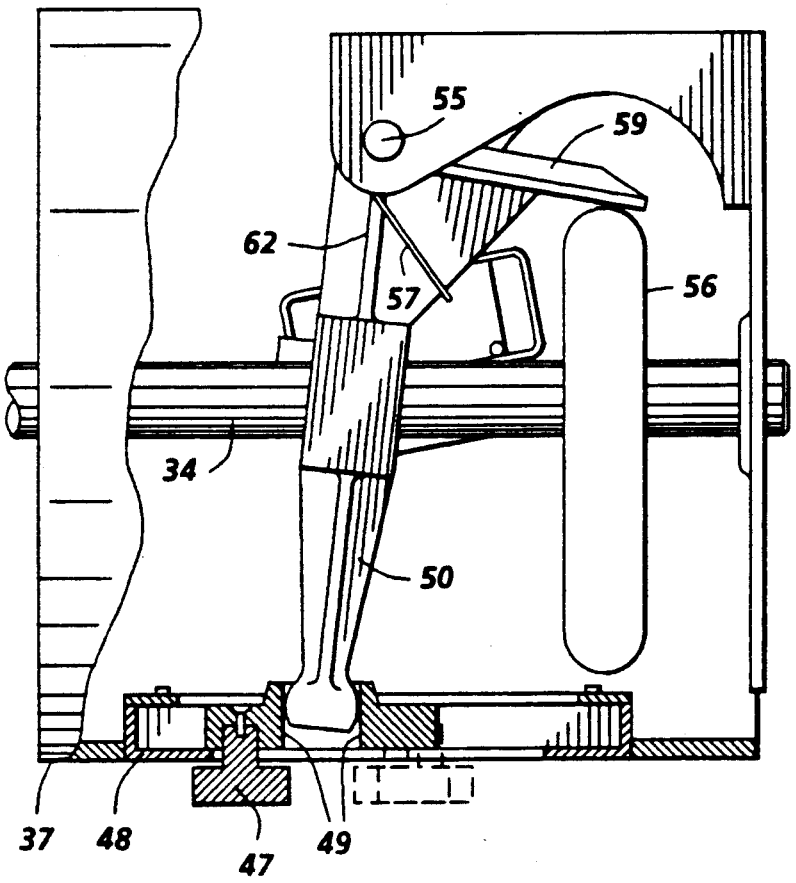
FIG. 4 is a view looking down through plane AA of FIG. 3 showing the offsetting mechanism in its fully extended position with the latch disengaged providing maximum side edge offsetting. The dotted line for the offset registration member represents the position with the latch engaged.
Figure 5:
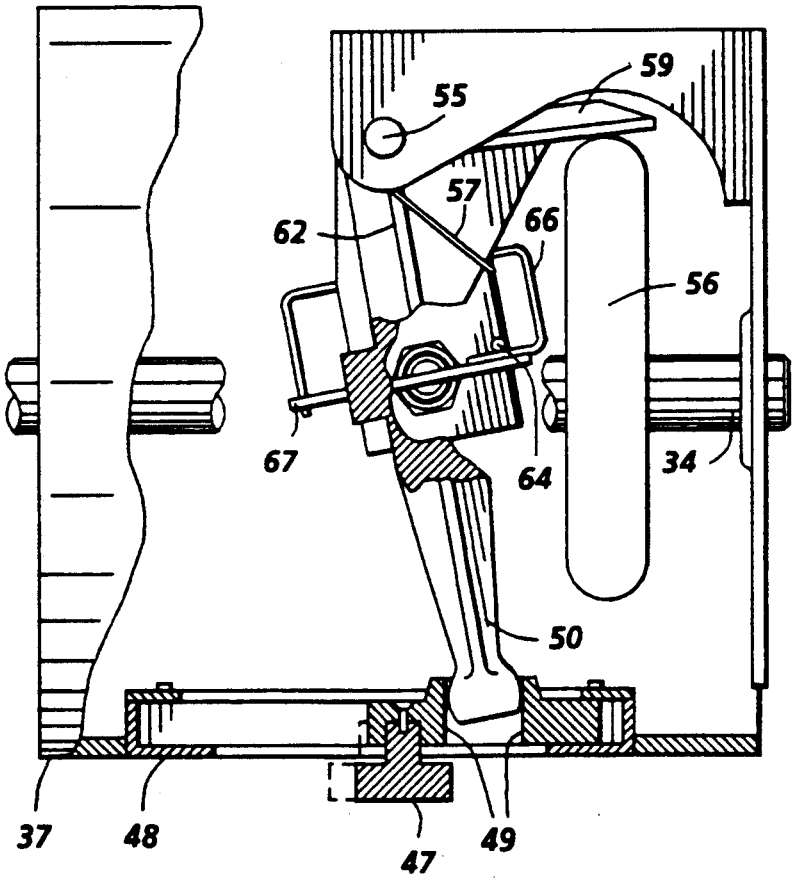
FIG. 5 is a view looking down through plane AA of FIG. 3 showing the offsetting mechanism in it fully retracted or home position with part of the cam follower assembly broken away to show details of construction.

For a further description of this mechanism attention is directed to FIGS. 3, 4, 5 and, 6 7. The offset tapper head 47 is mounted in a slideable support bracket 49 which rides in a frame 48 fixedly mounted in the stationary hub or drum 37. FIG. 4 depicts the position of the bracket fully extended (latch open) for maximum sheet tapping action or offset. The dotted line position in FIG. 4 represents the position of tapping head 47 when in its first offsetting position (latch closed). FIG. 5 shows the tapping head 47 in its fully retracted or home position. From position to position the assembly is controlled by the pivotal arm 50 which is positioned to ride through slot 51 on drive shaft 34. The arm 50 is pivoted at pivot point 55 which is fixedly mounted to the stationary hub or drum 37.

Figure 6:
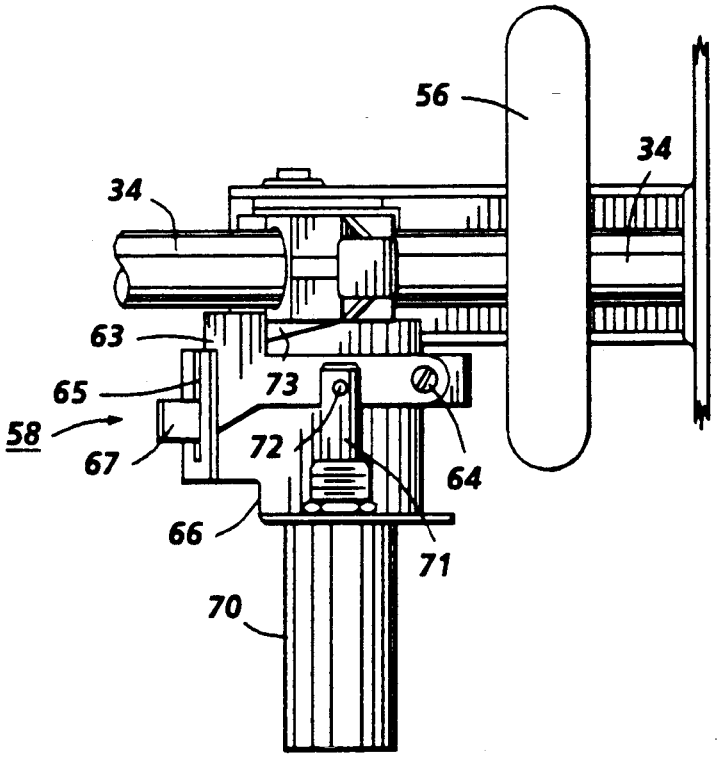
FIG. 6 is a view looking up through the plane BB of FIG. 3 showing the latch mechanism in the first offsetting position.

The position of the pivotal arm 50 is controlled by the joint action of a cam 56, a wrapped spring 57 and a latching mechanism 58 which may be more completely seen within reference to FIG. 6. The cam 56 is fixedly mounted to drive shaft 34 so that the operation of the offsetting head may be perfectly and continuously synchronized with the inverter wheel 32. As the cam 56 rotates the position of the cam follower 59 is altered thereby altering the location of the tapper head 47. With the cam lobe at its maximum extension at the top as may be seen in FIG. 5 the cam follower 59 is raised up and the tapper head moved to the extreme right to its base or home position. As the cam 56 continues to rotate and the maximum dimension of the cam lobe is reduced, the spring 57 wrapped around pivot 55 contacts spring stop 62 and urges the pivotal arm 50 to the left thereby moving the tapping head 47 to its maximum offset extension as may be seen in FIG. 4. Thus the cam and the spring jointly provide two positions for the tapping head, the home inoperative position and the maximum tapping or offset position. Since the cam follower will always control the position depending on its configuration over the urging action of the spring the length of the cycle in the maximum position may be readily controlled by the shape of the cam face since the cam is fixed to the inverter drive shaft.

To provide a second stop position in addition to the home and maximum positions a retractable latch mechanism which may be more completely understood with reference to FIGS. 3, 5 and 6 is provided. This latch mechanism includes a pivotal latch arm 63 which pivots about point 64 with one end 67 which rides in slot 65 in latch frame 66 to maintain the latch at a constant level. The latch frame 66 is fixedly mounted to the stationary hub or drum 37 and also provides support for the solenoid 70 which through solenoid plunger 71 and pin 72 moves the latch arm 63 into engagement and disengagement with the latch stop 73 on pivotal arm 50. As may be more readily seen with reference to FIGS. 4, 5 and 6 when the solenoid 70 is energized it withdraws the latch arm from engagement with the latch stop 73 on the pivotal arm 50 enabling the arm to move axially along the drive shaft to its maximum position. However when the solenoid 70 is de-energized the latch end 67 contacts the latch stop 73 of the pivotal arm hereby inhibiting further travel of the pivotal arm along the drive shaft 34 and providing a three position offsetting arrangement wherein two positions are automatically synchronized to the action of the sheet transport inverter wheel and the third position controlled by the solenoid actuated latch assembly which may be readily controlled by simple machine logic.

Figure 7:
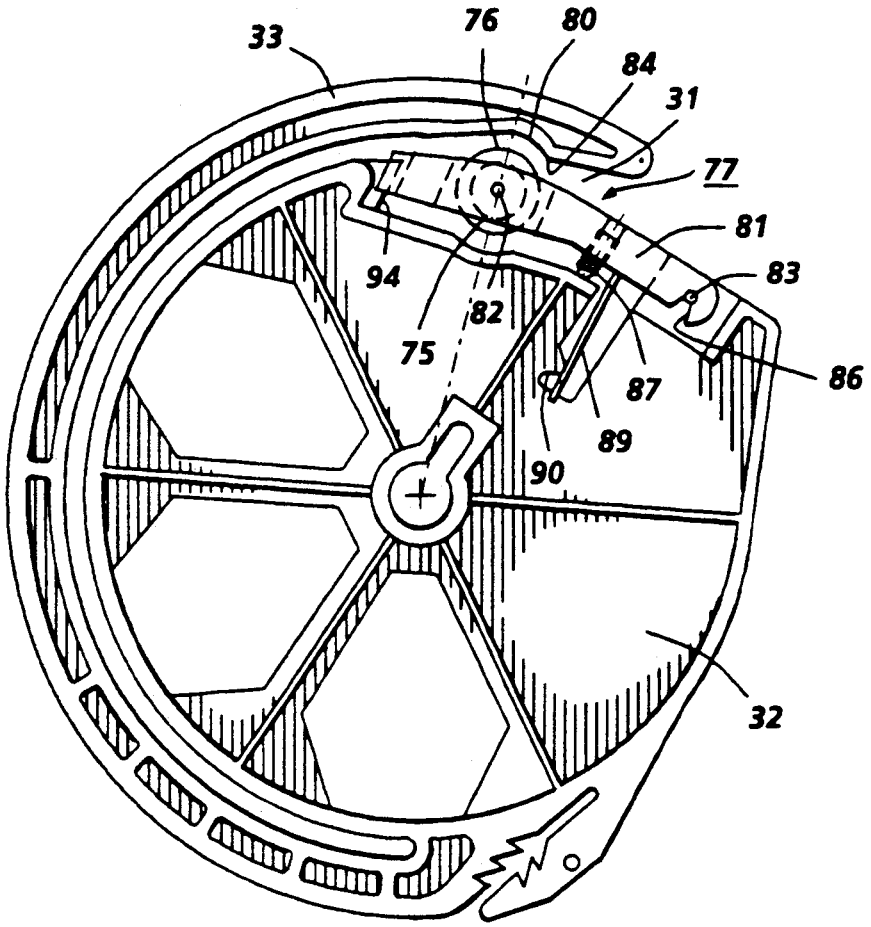
FIG. 7 is a cross sectional view of one inverter wheel according to the present invention.
Figure 8:
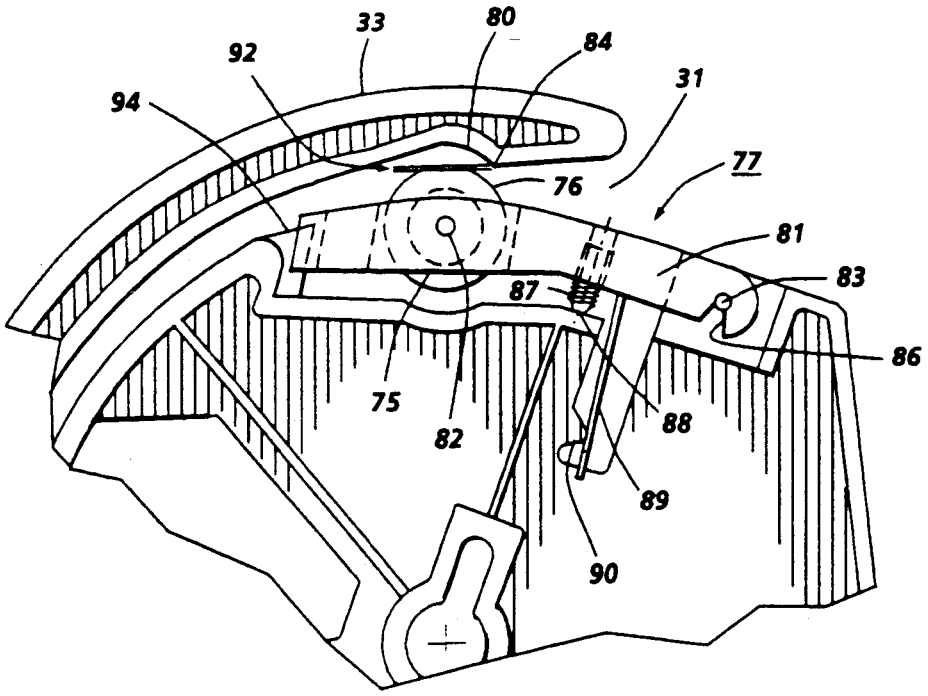
FIG. 8 is an enlarged cross sectional view of a portion of the inverter wheel illustrating more clearly the removable roller assembly according to the present invention.

Attention is now directed to FIGS. 7 & 8 for a more detailed description of the apparatus for providing minimal resistance to sheet movement in the slot upon sheet insertion in the slot in the process direction and to provide high resistance to sheet movement in the slot in a sideways or lateral direction transverse or perpendicular to the process direction particularly when a sheet is withdrawn from the slot.

The resistance device comprises a roller 75 having a high frictional contact surface 76 which is rotatably mounted for free rotation in the process direction in the entrance to the accurate sheet retaining slot 31. Typically the high frictional contact surface is a sleeve or tire on a roll having a Shore A hardness of from about 40 to about 50 and preferably 45 thus providing a desirable balance between high friction coefficient and low abrasion wear rate, and a coefficient of friction greater than one which can be maintained within a narrow region over a considerable period of time to ensure continuity of successful operation. Typical materials include silicone rubbers such as Endure 2000 available from Rogers Corporation, Rogers, Connecticut. The roller is mounted on axle shaft 82 in position in roller support member 81 forming part of roller assembly 77. The roller is free to rotate in the process direction but is not free to move laterally. The arm 33 of the inverter wheel has a sheet guide member 80 formed on its inner side on the entrance to the sheet retaining slot 31, a portion of which 84 is in opposed relationship with the roller 75 forming with the roller 75 an interference 92 in the nominal tangential sheet path. It is this interference in the sheet transport path which inhibits sheet movement in the slot in a sideways or lateral direction transverse or perpendicular to the process direction. This interference is greater than zero and less than 1 millimeter preferably from about 0.25 to about 0.75 mm. If the interference is zero there is little resistance to sheet movement in the slot in a lateral direction. If the interference is greater than about 1 mm the capability to insert light weight sheets diminishes. Typically the interference in the nominal tangential sheet path is about 0.5 mm. The sheet guide member acts to guide or funnel the lead edge of a sheet on its continuing path as well as provide the normal force urging the sheet toward the roller which produces the resistance to lateral movement of the sheet.

The roller assembly 77 is pivotally mounted about pivot axis 83 by snap holder 86 and the position of the roller is adjusted relative to the opposing guide member by means of adaptable set screw 87 which is used to raise and lower the roller into interference relationship with the portion of the guide member. The cantilever spring 89 urges the set screw 87 against stop member 88. The roller assembly is removable from the inverter wheel 32 merely by urging the free end 94 of the support member 81 downwardly disengaging the snap holder 86 from the shaft 83. The pivoting construction of the roller assembly enables adjustment of the position of the roller in the insertion slot. The roller assembly may be inserted into the inverter wheel by first positioning the wide mouth of the snap holder on the axis at which time the cantilever spring will not be in engagement with stop member 90. By pressing down on the pivoting end of the support member the snap holder engages the pivot shaft and locks in place while the cantilever spring engages its stop member thereby urging the support member to pivot downwardly until the end of the set screw engages its stop member.

In operation a sheet is driven into the insertion slot and since the direction of motion of the sheet in the process direction is the direction in which the roller is freely rotatable little resistance to feeding in the process direction is present. However, because of the interference relationship developed by the roller and the guide member, a normal force is generated urging the sheet toward the frictional contact surface of the roller which together provide the frictional force that resists lateral movement of the sheet. The coefficient of friction of the contact surface of the roller is indeed related to the interference with the nominal tangential sheet feeding path in that for greater interference in the tangential path one can use a frictional contact surface having a lower coefficient of friction and obtain the same result with a geometry having a lesser interference but a frictional contact surface having a greater coefficient of friction. Once the sheet has been inserted the inverter wheel is rotated and during this rotation, in view of the movement of the roller the force driving the sheet during inversion increased because of the interference between the roller and the opposing guide with the sheet in the middle as the roller turns counterclockwise to the unload position. At the unload position the offset mechanism is actuated to provide a desirable cross machine displacement between sets of sheets with force sufficient to overcome the resistance. However, after the offset registration member has peaked penetration in the lateral direction it stops to return to a home position. At this time with the sheet still in the slot on the inverter the roller and guide member interference provide the high resistance to lateral travel of the sheet and thereby provide stacking and offset stacking with a scatter of individual sheets or sets of sheets near zero.

Thus according to the present invention a simple inverter and stacking apparatus has been provided which may operate at increased speeds without producing unacceptable scatter among successive sheets or sets of sheets in an offsetting stacker. This increased latitude in terms of printing speed capability together with acceptable scatter enables a higher level of much more customer acceptability. It also has the advantage in that the roller assembly is removable and thereby may be completely replaced by a routine service. It has the additional advantage in that the sheet drive force on the sheet has increased during inversion because of the interference between the roller and the opposing guide with the sheet in middle.

The patents referred to herein are hereby totally and completely incorporated herein by reference.

While the present invention has been described with reference to the specific embodiment described herein, it will be apparent that many alternatives, modifications and variations may be made by those skilled in the art. For example, while the invention has been illustrated with the roller mounted to the interior body of the inverter wheel, it will be understood that the roller may be mounted in the arm forming the slot therebetween with the interior body of the inverter wheel. Accordingly it is intended to embrace all such alternatives and modifications as may fall within the spirit and scope of the appended claims.

What is claimed is:

1. Sheet inverter and stacking apparatus comprising at least one sheet inverter wheel having at least one arcuate sheet retaining slot into which a sheet maybe inserted, means to incrementally rotate said wheel from a sheet load position to a sheet unload position; drive means to drive a sheet in the process direction into said slot when said inverter wheel is in the load position; means to remove a sheet from said slot, stack it in a stacking tray and register its leading edge; said sheet retaining slot comprising means to provide minimal resistance to sheet movement in the slot upon insertion in the slot in the process direction and to provide high resistance to sheet movement in the slot in a sideways direction transverse to the process direction comprising a sheet guide member on the entrance to said arcuate sheet retaining slot and a roller assembly in the entrance to said arcuate sheet retaining slot, said roller assembly comprising a roller having a frictional contact surface rotatably mounted for free rotation in the process direction, said guide member being in opposed relationship with said roller, said guide having a portion forming with said roller an interference in the nominal tangential sheet path thereby providing a high resistance to sheet movement in the slot in a sideways direction transverse to the process direction.

2. The apparatus of claim 1 wherein the interference in the nominal tangential sheet path is less than about 1.0 mm.

3. The apparatus of claim 1 wherein said roller assembly comprises a roller support for freely rotatably supporting said roller in the process direction said support being pivotally mounted on said wheel, said support having an adjustable positioning element for positioning said roller in said slot entrance, means to spring bias said positioning element into position against a stop member.

4. The apparatus of claim 3 wherein said roller assembly is removably and replaceably mounted on said wheel.

5. The apparatus of claim 1 wherein said roller has a hardness of from about 40 to 50 Shore A.

6. The apparatus of claim 1 wherein said means to incrementally rotate said sheet inverter wheel brings said wheel to a stop at both the load and unload positions.

7. The apparatus of claim 1 wherein said inverter wheel is in the load position when the slot opening is at the top and is in the unload position when the slot opening is at the bottom of the path through which the wheel is rotated.

8. The apparatus of claim 1 further including an offset registration member positioned along edge of the sheet transport adjacent the unload position, said offset registration member being movable laterally with a directional component transverse to the direction of sheet transport, means to laterally move said offset registration member with a directional component transverse to the direction of sheet transport as said sheet is transported past said member whereby the side edge of said sheet is gently tapped, offset and registered during its path of travel.

9. The apparatus of claim 8 wherein the interference in the nominal tangential sheet path is less than about 1.0 mm.

10. The apparatus of claim 8 wherein said roller has a hardness of from about 40 to 50 Shore A.

11. The apparatus of claim 8 wherein said means to incrementally rotate said sheet inverter wheel brings said wheel to a stop at both the load and unload positions.

12. The sheet apparatus of claim 8 wherein said inverter wheel is in the load position when the slot opening is at the top and is in the unload position when the slot opening is at the bottom of the path through which the wheel is rotated.

13. The apparatus of claim 8 wherein said roller assembly comprises a roller support for freely rotatably supporting said roller in the process direction said support being pivotally mounted on said wheel, said support having an adjustable positioning element for positioning said roller in said slot entrance, means to spring bias said positioning element into position against a stop member.

14. The apparatus of claim 13 wherein said roller assembly is removably and replaceably mounted on said wheel.

15. The apparatus of claim 1 wherein said slot is sufficiently long in arcuate length to accommodate at least a substantial portion of the length of a sheet to be inverted without the leading edge of the sheet contacting the end of the slot, and the distance between the sheet drive means and the end of the slot in the inverter wheel when in the load position is greater than the length of a sheet to be fed whereby the leading edge of the sheet does not contact the end of said slot.

16. The apparatus of claim 15, wherein the interference in the nominal tangential sheet path is less than about 1.0 mm.

17. The apparatus of claim 15 wherein said roller has a hardness of from about 40 to 50 Shore A.

18. The apparatus of claim 15 wherein said means to incrementally rotate said sheet inverter wheel brings said wheel to a stop at both the load and unload positions.

19. The sheet apparatus of claim 15 wherein said inverter wheel is in the load position when the slot opening is at the top and is in the unload position when the slot opening is at the bottom of the path through which the wheel is rotated.

20. The apparatus of claim 15 wherein said roller assembly comprises a roller support for freely rotatably supporting said roller in the process direction said support being pivotally mounted on said wheel, said support having an adjustable positioning element for positioning said roller in said slot entrance, means to spring bias said positioning element into position against a stop member.

21. The apparatus of claim 20 wherein said roller assembly is removably and replaceably mounted on said wheel.

* * * * *